United States Patent [19]

Manizza

[11] 4,130,236

[45] Dec. 19, 1978

[54] TRAY TYPE CONTAINER

[75] Inventor: Guelfo A. Manizza, Blauvelt, N.Y.

[73] Assignee: Federal Paper Board Co., Inc., Montvale, N.J.

[21] Appl. No.: 855,245

[22] Filed: Nov. 28, 1977

[51] Int. Cl.[2] ..... B65D 5/24

[52] U.S. Cl. ..... 229/31 R

[58] Field of Search ..... 229/31 R, 3.1, 30, 31

[56] References Cited

U.S. PATENT DOCUMENTS

| | | | |
|---|---|---|---|
| 2,669,914 | 2/1954 | Swaine | 229/31 R X |
| 3,038,634 | 6/1962 | Cheeley | 229/31 R UX |
| 3,536,248 | 10/1970 | Odenhagen | 229/31 R |
| 3,550,835 | 12/1970 | Persson | 229/31 R |
| 3,701,467 | 10/1972 | Johansson | 229/31 R |
| 3,733,023 | 5/1973 | Arneson | 229/31 R |
| 3,863,830 | 2/1975 | Christensson | 229/31 R |

*Primary Examiner*—Davis T. Moorhead
*Attorney, Agent, or Firm*—Guy A. Greenawalt

[57] ABSTRACT

A tray particularly adapted for containing a flowable material, such as, a food product which may be heated prior to consumption, wherein the tray is formed from a single blank of foldable sheet material, for example, paperboard having a heat resistant coating, which blank is cut, creased and folded so as to provide a rectangular bottom wall with upstanding sidewalls which are joined at the ends by integral web sections folded and secured so as to provide relatively rigid posts at each of the corners with inwardly bowed generally rectangular inside surfaces and with the bottom ends on curved lines which bridge the ends of spaced parallel fold lines at the juncture of the bottom wall forming panel and the sidewall forming panels whereby the interior of the tray presents curved surfaces in the areas where the walls intersect.

6 Claims, 5 Drawing Figures

FIG. 1
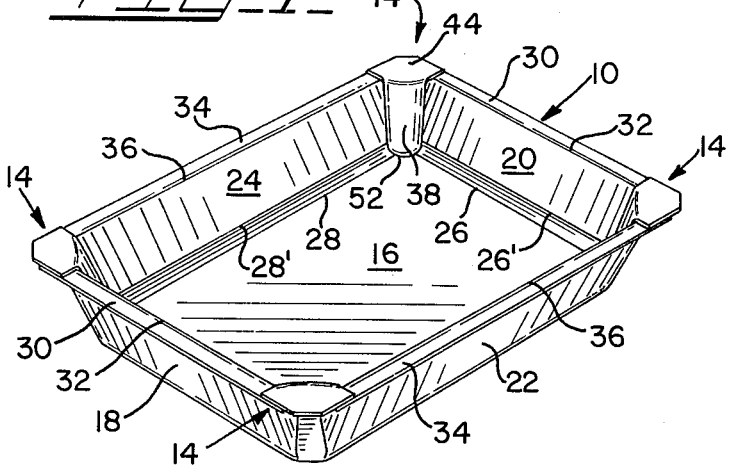
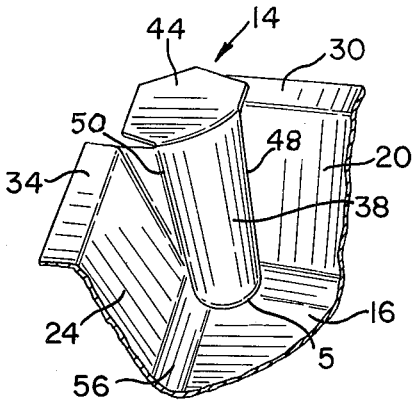
FIG. 4
FIG. 2
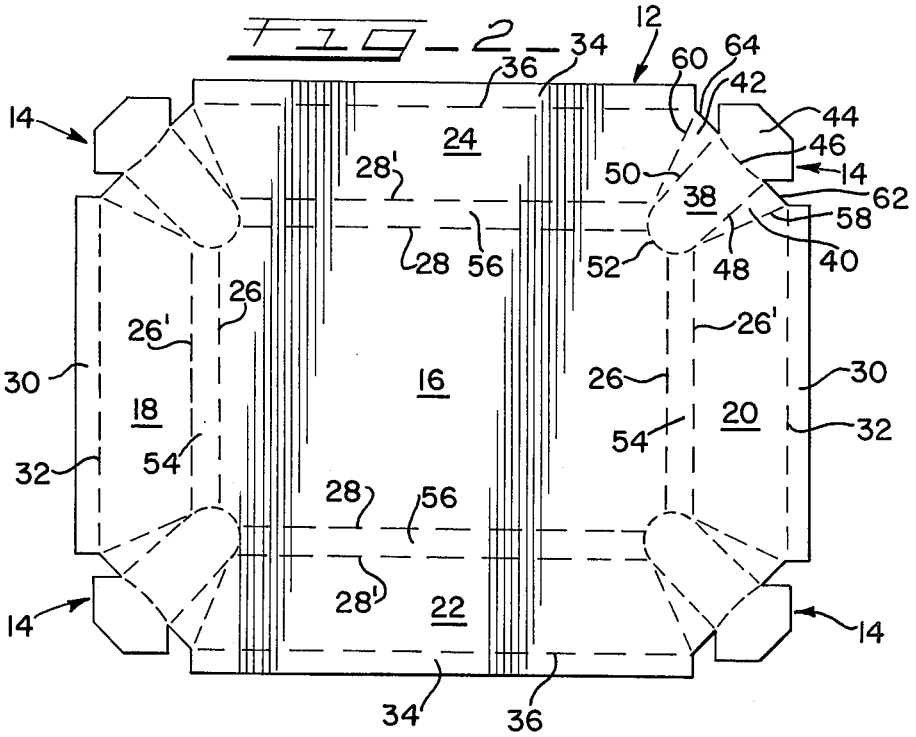
FIG. 3
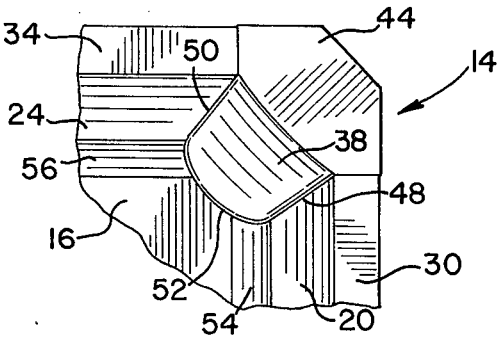
FIG. 5
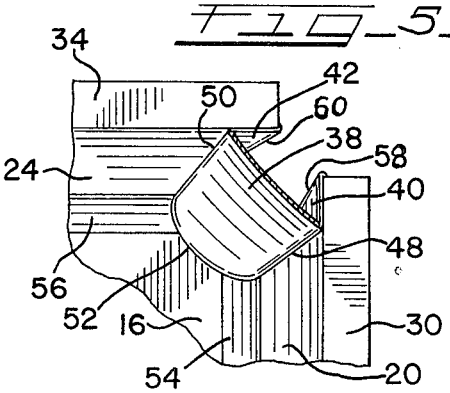

TRAY TYPE CONTAINER

BACKGROUND OF THE INVENTION

This invention relates to tray formations which are particularly useful in connection with the packaging of food products and is more particularly concerned with improvements in a tray construction which will serve as a leakproof container for products in liquid or semi-liquid form and which may be fabricated of paperboard with a coating of heat resistant material so as to be capable of withstanding, without breakdown, the temperatures encountered when heating or processing in a high frequency oven, a heating bath or a heating plate.

Trays have been designed heretofore which are adapted for use in the food industry where it is desired to package products which are in various forms and various stages of processing so that the product can remain in the tray while it is processed or while the processing is completed in an oven, hot bath, or the like, and then consumed, with the tray serving as a convenient serving dish. Generally, these trays have been formed of a metal foil which will withstand the temperature necessary to process the product. Some efforts have been directed toward providing tray structures formed from non-metal materials which are sufficently heat resistant for oven processing. One such tray arrangement is described in U.S. Pat. No. 3,550,835 granted Dec. 29, 1970.

Many of the prior containers of this type have not proven entirely acceptable for one reason or another. Some of them have not been designed so as to provide a leakproof construction enabling the packaging of a fluid product in a satisfactroy manner. Some of them have not been satisfactory as a serving dish. Others have been too costly for disposable use or have required special machinery for their fabrication which has increased the cost to an objectional degree.

It is a general object of the present invention to provide an improved tray type packaging container which may be formed of a foldable sheet material capable of withstanding temperatures encountered in various food processing equipment, which is leakproof, sufficiently sturdy to permit substantial stacking, more economical to manufacture and more satisfactory for use as a serving dish than similar containers heretofore provided.

It is a more specific object of the invention to provide a tray type container which is formed from a single blank of paperboard or other suitable sheet material wherein a generally rectangular bottom wall is joined to upstanding sidewalls by relatively narrow outwardly bowed sections of material and the sidewalls are connected to each other at their opposite ends by integral web sections having inwardly bowed inner faces and forming relatively rigid corner posts.

Another object of the invention is to provide a tray type container which may be formed of a single blank of paperboard material, or the like, and which comprises a generally rectangular bottom wall connected to the bottom portions of upstanding sidewalls by outwardly bowed segments of the material extending between spaced score lines and having sidewalls connected to each other at their opposite ends by integral web structures with a generally rectangular main portion, the bottom edge of which is defined by an inwardly curved score line which connects the score lines of the adjoining sidewall panels.

A further object of the invention is to provide a tray of the character described for containing a food product, or the like, which is characterized by a generally rectangular bottom wall with upstanding peripherial sidewalls wherein the material at the juncture of the sidewalls with the bottom wall, and with each other, is formed, so as to provide the tray with curved or rounded interior surfaces.

Another object of the invention is to provide a tray, of the character described, which is fabricated from a single blank of foldable sheet material, wherein the blank is scored to form a bottom wall panel and adjoining sidewall panels which are separated from the bottom wall panel by double score lines spaced to provide a rounded corner edge when the sidewall panels are hinged to upright position relative to the bottom wall panel and corner connecting webs defined by score lines which have a curved configuration at the bottom ends for connecting the double score lines of the adjoining panels.

A still further object of the invention is to provide a tray type container structure, of the character described, wherein the tray may be fabricated from a single cut and scored blank of foldable sheet material by employing normal folding techniques.

To this end the invention, as disclosed and claimed herein, comprises a tray type container formed from a single blank of foldable sheet material which includes a bottom wall and peripherial sidewalls upstanding from the margins of the bottom wall and integrally joined at adjacent ends by post forming foldable web members which are contoured to afford a curved edge connection with the bottom wall and with curved hinge areas connecting the sidewalls and the bottom wall.

The aforesaid and other objects and advantages of the invention will become more apparent upon consideration of the preferred form of the tray construction which is illustrated in the accompanying drawings wherein like parts are identified by the same numerals throughout the views.

BRIEF DESCRIPTION OF THE DRAWINGS

FIG. 1 is a perspective view of a tray type container which embodies the principle features of the invention;

FIG. 2 is a plan view of the inside face of a blank which is cut and scored to form the tray of FIG. 1;

FIG. 3 is a fragmentary plan view showing one corner of the tray of FIG. 1, to a larger scale;

FIG. 4 is a fragmentary plan view similar to FIG. 3, with the corner connecting web only partially folded into post forming position; and FIG. 5 is a fragmentary plan view similar to FIG. 3 with the top portion of the corner connecting post formation cut away.

DESCRIPTION OF THE PREFERRED EMBODIMENTS OF THE INVENTION

The completely formed tray 10 which is shown in FIG. 1 is fabricated from a blank 12 of foldable sheet material which is cut and scored as shown in FIG. 2. The blank material is preferably cut from paperboard stock of suitable gauge which has been coated with a heat resistant plastic so as to permit processing or treatment of the contents of the tray, in a microwave oven or other heated environment, when it is used in the packaging of a food product which is adapted to be heat processed before use.

The blank 12, which is generally rectangular, is cut and scored so that it is symmetrical about longitudinal and transverse center lines, and provides bottom and sidewall forming panels with four integral corner sections 14, which are cut and scored in an identical manner. The blank is divided into a generally rectangular center panel 16, which is adapted to form the bottom wall of the tray, and pairs of oppositely disposed sidewall forming panels 18, 20, and 22, 24, by longitudinally spaced pairs of transverse score lines 26, 26' and transversely spaced pairs of longitudinal score lines 28, 28'. In the form illustrated, each of the two short sidewall forming panels 18 and 20 has a narrow top flange forming strip 30 extending along its outer margin and outboard of a hinge forming score line 32 which is parallel with the score lines 26 and 26'. The other two longer sidewall panels 22 and 24 have corresponding narrow top flange forming strips 34 extending outboard of score lines 36 which parallel the score lines 28 and 28'. Each of the sidewall panels 18, 20, 22 and 24 extends at its opposite ends to a corner post forming section 14 which integrally connects it to the end of the adjacent sidewall forming panel.

Each of the corner sections 14 is scored and cut in an identical manner and only one will be described. Each section 14 is divided into a generally rectangular central panel 38, and two triangular shaped side panels 40 and 42 with a flange connecting flap 44 of generally diamond shape extending outboard of the center panel 38 and separated therefrom by score line 46 which bows inwardly. The center panel 38 is defined by generally parallel spaced score lines 48 and 50 which extend inwardly toward the center panel 16 and merge at their inner ends with a score line portion 52 which is curved inwardly on approximately a half circle. The curved score line 52 extends across the ends of the otherwise intersecting pairs of score lines 26, 26' and 28, 28' which define narrow strips of material 54 and 56 between outer margins of the bottom wall forming panel 16 and inner margins of the adjacent sidewall forming panels 20 and 24. The curved score line 52 at each of the corners forms a corner bridge between the adjacent ends of the bottom edge forming strips 54 and 56 which lie between the score lines 26, 26' and 28, 28' and connect the score lines so as to enable strips 54 and 56 to bow or curve outwardly at their ends. Score lines 58 and 60 extend outwardly from the intersecting points of the outermost side edge score lines 26' and 28' with the inwardly curved score line 52, at an angle to the score lines 48 and 50, to the ends of the hinge forming score lines 32 and 36 for the top edge adjoining members 30 and 34. Cutting lines 62 and 64, which form extensions of the curved score line 46, define the outboard edges of the triangular fold panels 40 and 42, the material being cut away between the ends of the flange members 32 and 34 and the diamond shaped flange connecting flap 44. The corner web fold panels 40 and 42 are adapted to fold against the inside faces of the marginal end portions of the sidewall panels 20 and 24 when the tray is set up.

With the blank 12 prepared as shown in FIG. 2, the tray may be readily set up employing conventional folding techniques. The corner web structures connecting the sidewall ends are folded inwardly as the sidewall panels are moved to an upright position relative to the bottom wall forming panel 16 and the triangular web members 40 and 42 fold against the inside faces of the end portions of the sidewall members to which they are connected. The web panels 38 bow inwardly while the bottom edge strips 54, 56 are free to bow outwardly due to the curved score lines 52 at the bottom of the corner post formations which result from the folding of the corner connecting web structures. The rigidity of the corner posts is increased by the curvature imparted to the main panel 38. The flange connecting flaps 44 are folded outwardly on the hinge lines 46 with portions overlapping and adhesively secured to end margins of the flange members 30 and 34 (FIG. 3), the diamond shaped connecting flaps 44 being given the desired configuration to provide the connections.

I claim:

1. A package forming tray adapted for containing a fluid product which tray is formed from a single blank of foldable sheet material having an interior surface providing a leakproof construction, said tray comprising a generally rectangular bottom wall forming panel and upstanding sidewall forming panels which are connected to each other at their ends by integral corner web formations, said bottom wall forming panel being connected to said sidewall forming panels by relatively narrow sections of material defined by spaced, generally parallel hinge lines which sections of connecting material have an outward curvature in transverse section and each of which, at the ends thereof, terminates at a bowed line defining the bottom edge of the associated corner web formation, said corner web formation including a generally rectangular center section terminating at the bottom on said bowed line and sections on each side of said center section which are generally triangular and which are folded and secured in overlying relation with inner end marginal portions of the sidewall forming panels to which they are hingedly connected thereby forming relatively rigid corner posts.

2. A package forming tray as set forth in claim 1 wherein said sidewall forming panels each have a narrow outturned flange extending along the top edge thereof which top edge flanges are connected at their adjacent ends by outturned flange formations on said corner web formations.

3. A package forming tray as set forth in claim 1 wherein said sidewall forming panels each have a narrow flange formation extending along the top edge thereof which flange formations are joined at their adjacent ends by connecting flaps, said flaps being hinged to the top edge of the center section of the corner web formation.

4. A blank of foldable sheet material for forming a tray type container which is cut and scored to provide a rectangular bottom wall forming center panel, surrounding sidewall forming panels and connecting corner web formations, said center panel being separated from said sidewall forming panels by spaced, generally parallel, double score lines defining between them a narrow connecting edge forming strip, said corner connecting web formations which extend between the ends of said sidewall panels each comprising a central panel section defined by spaced, generally parallel score lines which extend inwardly of the blank outer edges and merge into an inwardly curved connecting score line defining the inner terminus of the web formation, said double score lines which define said edge forming strip terminating at opposite ends at an inwardly curved score line which defines the inner terminus of the associated connecting corner web formation.

5. A blank as set forth in claim 4 wherein said curved inner score line forming the terminus of each said connecting corner web formation extends into said bottom wall forming center panel.

6. A blank as set forth in claim 4 wherein narrow flange strips are formed in the margins of the blank by score lines spaced inwardly of the blank edges and connecting tabs for said flange strips are formed at the corners of said blank which are each defined in part by an inwardly spaced hinge forming score line dividing the same from a center section of the connecting corner web formation.

* * * * *